US006386816B1

(12) United States Patent
Urea et al.

(10) Patent No.: US 6,386,816 B1
(45) Date of Patent: May 14, 2002

(54) PRINTED MATTER TRANSPORT DEVICE

(75) Inventors: Yoshinori Urea; Kazuyuki Motojima, both of Kanagawa-ken (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/953,251

(22) Filed: Sep. 17, 2001

Related U.S. Application Data

(63) Continuation of application No. 09/497,795, filed on Feb. 4, 2000, now abandoned.

(30) Foreign Application Priority Data

Aug. 30, 1999 (JP) ..... 11-243,936

(51) Int. Cl.[7] ..... B62B 1/06

(52) U.S. Cl. ..... 414/453; 221/204; 101/408; 198/596; 294/104

(58) Field of Search ..... 271/204; 101/408; 198/596, 867.1, 803.7, 803.9; 209/903; 221/227; 399/304; 414/453; 294/103.1, 104

(56) References Cited

U.S. PATENT DOCUMENTS 4,294,345 A 10/1981 Stauber et al.
4,512,457 A 4/1985 Reist et al.
4,638,906 A 1/1987 Winlasz
4,746,007 A * 5/1988 Houseman ..... 194/470.1
4,852,722 A * 8/1989 Houseman ..... 198/803.7
5,188,349 A 2/1993 Honegger
5,261,656 A 11/1993 Gutov et al.
5,380,000 A 1/1995 Ohno
5,992,610 A 11/1999 Dufour et al.
6,007,064 A 12/1999 Cote et al.
6,227,589 B1 * 5/2001 Brown et al. ..... 294/104

* cited by examiner

*Primary Examiner*—David H. Bollinger
*Assistant Examiner*—Kenneth W. Bower
(74) *Attorney, Agent, or Firm*—Greenblum & Bernstein P.L.C.

(57) ABSTRACT

A printed matter transport device. Printed matter is gripped by a gripping mechanism of a chain and made to travel along a guide rail, to improve the durability of the guide rail and chain, to prevent misalignment, falling out and damage when an external force acts on the printed matter, to improve durability of a connecting part of a chain link and the gripping mechanism, to reduce manufacturing costs, and to enable the printed matter to be firmly gripped. A chain with grips having first rollers respectively arranged on two sides in the center of the longitudinal direction of the bases, a second roller on one side perpendicular to the common center line of the first rollers and a grip mechanism on the opposite side, a guide rail, a chain drive and a cam member are provided.

10 Claims, 13 Drawing Sheets

PRINTED MATTER TRANSPORT DEVICE

This is a Continuation of U.S. application Ser. No. 09/497,795, filed Feb. 4, 2000 now abandoned, the contents of which are expressly incorporated by reference herein in their entireties.

BACKGROUND TO THE INVENTION

1. Field of the Invention

This invention relates to a device for collecting a printed matter folded by a folding device of a rotary press. More specifically, it relates to a printed matter transport device comprising plural links connected in an endless fashion so that they can undergo angular displacements up and down, or left and right, of a longitudinal direction in a connecting part, wherein these links are provided with grip mechanisms so as to form a chain with grips, the printed matter is gripped by these grips, and the chain with grips is made to travel along a guide rail.

2. Description of the Related Art

Printed matter transport devices of the above type are described for example in Japanese Patent Laid-Open Hei 5-97302, Japanese Patent Publication Sho 59-48204, Japanese Patent 2527724, Japanese Patent 2675520 and U.S. Pat. No. 4,638,906.

In the chain with grips disclosed in Japanese Patent Laid-Open Hei-5-97302, plural chain links are formed by providing two legs having a suitable gap at one end and a projection in the gap between the two legs which can undergo an angular displacement within a suitable angular range at the other ends the two legs and the projections of adjacent links are connected by a spherical bearing provided to the projection and a shaft passing through this spherical bearing, the two ends of the shaft pass through the legs and extend outside, and first rollers free to rotate are provided at both ends of this shaft.

A projection which projects in a perpendicular direction to the direction in which the two legs face each other is formed on one side excepting the two sides on which the first rollers are formed, the end of this projection being an extension which extends in an L-shape below the spherical bearing, and a second roller which is free to rotate around a center line perpendicular to the center line of the shaft is provided on this extension.

A grip mechanism comprising a fixed grip member and an angular displacement grip member provided on this fixed grip member such that it is free to undergo an angular displacement, these members respectively comprising grip action parts parallel to the shaft, is provided on the end face of the projection in the projection direction. In the grip mechanism, the angular displacement grip member undergoes an angular displacement due to a release cam and a closing cam provided in the chain travel path. As a result, the gap with the fixed grip member changes so that the grip member opens or closes. The open state and closed state are maintained by a toggle mechanism.

This chain with grips is made to travel along a guide rail.

SUMMARY OF THE INVENTION

In the chain with grips disclosed in Japanese Patent Publication Sho 59-48204, plural chain links are formed by providing two legs having a suitable gap at one end and a projection parallel to the legs in the gap between the two legs which can undergo an angular displacement within a suitable angular range at the other end, the two legs and the projections of adjacent links are connected by a spherical bearing provided to the projection and a shaft passing through this spherical bearing, the two ends of the shaft pass through the legs and extend outside, and first rollers free to rotate are provided at both ends of this shaft.

A lever which extends below the spherical bearing from the base of the two legs is provided to each chain link, and a second roller free to rotate around a center line perpendicular to the center line of the shaft is provided at the free end of this lever.

A rod having a center line parallel to the shaft extends from this arm on one side of the chain link. This rod captures the leading edge of a printed matter, and is assisted by a crank when transporting it.

This chain with grips is made to travel along a guide rail.

In the chainwith grips disclosed in Japanese Patent 2527724, plural chain links are formed from bases approximately having the shape of an isosceles triangle in a plan view. Two legs are provided with a suitable gap on the base part of the base and perpendicular to the base side, and a projection parallel to the legs in the gap between the two legs which can undergo an angular displacement relative to the legs within a suitable angular range, is provided at the apex. The two legs and the projections of adjacent links are connected by a spherical bearing provided to the projection and a shaft passing through this spherical bearing, the two ends of the shaft pass through the legs and extend outside, and first rollers free to rotate are provided at both ends of this shaft.

Second rollers free to rotate around an axis perpendicular to the shaft is provided to each chain link in the vicinity of the two ends of the base side such that their respective outer circumferential surfaces are situated further outside than the outer circumferential surfaces of the first rollers.

A grip mechanism comprising a fixed grip member and an angular displacement grip member provided on this fixed grip member such that it is free to undergo an angular displacement, these members respectively comprising grip action parts parallel to the shaft, is provided on a lower surface in the center part of each base. In the grip mechanism, the angular displacement grip member undergoes an angular displacement due to a release cam and a closing cam provided in the chain travel path. As a result, the gap with the fixed grip member changes so that the grip member opens or closes. To maintain the closed state, a closed state holding mechanism is provided comprising a wrap spring which wraps the outer circumferential surface of a pivot formed in one piece with the angular displacement grip member and a bush which supports this pivot such that it is free to undergo an angular displacement. The angular displacement grip member is held in the closed position by this mechanism.

This chain with grips is made to travel along a guide rail.

In the chain with grips disclosed in Japanese Patent 2675520, plural chain links are formed by providing two legs having a suitable gap at one end and a projection parallel to the legs in the gap between the two legs which can undergo an angular displacement within a suitable angular range at the other end, and the two legs and the projections of adjacent links are connected by a spherical bearing provided to the projection and a shaft passing through this spherical bearing.

Shafts having a common center line parallel to the facing direction of the two legs are connected to a lever which can undergo angular displacement together with an angular displacement grip member described later, and are provided on both sides of the chain link in the approximate center of each chain link. First rollers free to rotate are respectively provided to each of these split shafts.

A second roller free to rotate around an axis perpendicular to the aforesaid common center line is provided below a connecting part of each chain link.

A grip mechanism comprising a fixed grip member and an angular displacement grip member provided on this fixed grip member such that it is free to undergo an angular displacement, these members respectively comprising grip action parts parallel to the shafts, is provided on the lower surface of the center part of each base, and a lever to which the first rollers are attached is connected to the angular displacement grip member of the grip mechanism so that it can undergo an angular displacement together with it.

An action part lower than the other parts is provided on a guide surface of the guide rail which guides the motion of the chain, and which supports the first rollers from underneath. In this action part, when the first rollers displace along the guide surface, the angular displacement grip member is caused to undergo an angular displacement. As a result, the gap with the fixed grip member changes so that the grip mechanism opens or closes. At the same time, the up/down displacement of the first rollers is restricted by parts excepting the action part of the guide surface, and the angular displacement grip member is held in the closed position.

This chain with grips is made to travel along a guide rail.

In the chain with grips disclosed in U.S. Pat. No. 4,638,906, plural chain links are provided having a socket with a spherical inner surface at one end of the longitudinal direction, and a plug having the same center line as this socket at the other end. The outer surface is partially formed as a spherical surface, and two projections are provided separately on the socket side and plug side in a perpendicular direction to the aforesaid center line. Adjacent chain links are connected via universal joints wherein the plugs are inserted in the sockets.

A shaft perpendicular to the center line and perpendicular to the projecting direction of the projections, passes through the center part of each chain link, a first roller free to rotate is provided at both of its ends, and a second roller free to rotate around an axis parallel to the direction of the projections, is provided in the gap between the two projections such that its outer circumferential surface is situated further outside than the side faces of the two projections.

A grip mechanism comprising a fixed grip member and an angular displacement grip member provided on this fixed grip member such that it is free to undergo an angular displacement, these members respectively comprising grip action parts parallel to the shaft, is provided to these two projections. The grip mechanism constantly exerts a force tending to separate the angular displacement grip member from the fixed grip member. Due to a closing cam provided in the transport path of the chain, the angular displacement grip member is caused to undergo an angular displacement tending to close the gap with the fixed grip member against this force, and this state is maintained by a stopper action. Likewise, when this stopper is released by a release cam provided in the transport path of the chain, the angular displacement grip member is caused to undergo an angular displacement tending to open the gap with the fixed grip member due to this force.

This chain with grips is made to travel along a guide rail.

In the above five prior art techniques, when the chain with grips changes its travel direction (when it changes direction to a direction away from an imaginary plane containing its own rotation center line and the direction in which the chain links are connected), the first roller and second roller respectively come in contact with the guide surface of the guide rail which limits the travel direction of the chain with grips.

Other printed matter transport devices are known wherein the chain with grips is made to pass through a position corresponding to a printed matter discharge part of a folding device, and the printed matter is gripped by a grip mechanism passing this position, as disclosed in Japanese Patent Laid-Open Hei 8-188313, Japanese Patent 2534175 and Japanese Patent 2727281.

In the device disclosed in Japanese Patent Laid-Open Hei 8-188313, the chain with grips of the aforesaid Japanese Patent Laid-Open Hei 5-97302 is made to pass through a position corresponding to a printed matter discharge part of a folding device.

In the devices disclosed in Japanese Patent 2534175 and Japanese Patent 2727281, a chain with grips suspended between chain sprockets is made to pass through a position corresponding to a printed matter discharge part of a folding device. The chain with grips can change its travel direction within a plane perpendicular to the rotation center lines of the chain sprockets, but cannot change its travel direction to leave the plane.

In the device disclosed in Japanese Patent 2727281, a grip mechanism of the chain is attached so that it can undergo an angular displacement on the side of the chain, and an angular displacement lever is connected with this grip mechanism. A driven roller is provided at the tip of this angular displacement lever, and a positioning change guide rail which changes a positioning relative to the chain with grips while it is traveling in conjunction with this driven roller, is provided substantially along the length of the chain at a position near to the chain. When the grip mechanisms travel as the chain travels along, the driven roller provided at the tip of the angular displacement roller moves along the positioning change guide rail so that the positioning of the grip mechanisms is suitably changed.

The following problems were inherent in the aforesaid prior art.

In the device shown in Japanese Patent Laid-Open Hei 5-97302, the first rollers and second roller are installed in a connecting part of the link of the chain with grips, that is, at the end of the link.

Therefore, although there is no problem in traveling along a linear part as shown in FIG. 11B, when the chain with grips travels around a bend in a direction wherein the travel direction is restricted due to the second roller (FIG. 11A), the first roller makes an angle alpha relative to the travel direction of the chain with grips, i.e., the tangential direction of the curved part of the guide-rail, and a contact part with the guide rail slips as it travels down the guide rail.

Therefore, wear of the curved part of the guide rail was large. Moreover, the first rollers themselves suffer relatively large wear and an unsuitable force acts on the bearings of the first rollers, so durability was low. Further, as the first rollers slip on the guide-rail as they travel, noise is generated, and this was a contributing factor to deterioration of the working environment.

Moreover, the links of the chain with grips are connected, and the first rollers and second roller are attached at both ends of the links which are connecting parts. Therefore, the first rollers and second roller act together with the guide rail so that the connecting parts limit up/down and left-right motion relative to the longitudinal direction, and stop motion in link units.

Therefore, even if the grip mechanism in each link receives an outside force acting on the printed matter gripped therein, it cannot move according to the force. Depending on the direction of the force which is acting, the grip mechanism may therefore be forced open, and the printed matter may fall out. Moreover, if the gripping force is large, a large force may act on the printed matter, so that the printed matter is creased, wrinkled or torn.

In the device disclosed in Japanese Patent Publication Sho 59-48204, the first rollers and second roller are installed in the connecting part of the link of the chain with grips, that is, at the end of the link. Therefore, the device disclosed in 59-48204 had the same problem same as the device disclosed in Japanese Patent Laid-Open Hei 5-97302.

Moreover, in the device shown in 59-48204, a rod which captures the printed matter and grips the printed matter with the aid of a clamp extends to one side of a link of the chain with grips, so when the chain with grips travels while gripping the printed matter, the link inclines to the side on which the grip mechanism is installed. Therefore, the first rollers and second roller always travel in contact with the same part of the guide rail, so this part of the guide rail suffers severe wear, and consequently had low durability.

In the device disclosed in Japanese Patent 2527724, the first rollers are installed in the position of the connecting part of the link of the chain with grips, that is, at the end of the link. Therefore, there was the same problem as in the device shown in Japanese Patent Laid-Open Hei 5-97302 in the relation between the first rollers and the guide-rail.

Moreover, in the device disclosed in 2527724, the first rollers are installed at the end of the link, but the second rollers are provided substantially in the center part of the link. Therefore, when the chain with grips travels around a bend in a direction wherein the travel direction is restricted by the second rollers, the connecting part which is at the end of the link, this link being a rigid body, comes more in contact with the outside of the curved part of the guide rail in the radial direction than the center part of the link, as shown in FIGS. 12A and 12B. That is, the relation between distances a1, a2 between the edge of the guide-rail and the first roller in the straight part (FIG. 12B), and distances b1, b2 between the edge of the guide-rail and the first roller in the curved part (FIG. 12A), is b2<a1=a2<c2.

Therefore, when the chain with grips travels around a bend in a direction wherein the travel direction is restricted by the second rollers, the first rollers slip sideways in the radial direction of the curved part of the guide rail in the contact part with the guide rail. Consequently, wear of the guide rail in this part and wear of the first rollers in this part was even larger due to this sideways slipping than in the devices disclosed in Japanese Patent Laid-Open Hei 5-97302 and Japanese Patent Publication Sho 59-48204, and durability was still lower.

In addition, one each of the second rollers, which were provided effectively in the center part of the link of the chain with grips, is provided on both sides of the link, and it therefore comes near to the first rollers of the adjoining link. Hence, when the chain with grips travels around a bend in a direction wherein the travel direction is restricted due to the second roller, the second rollers and the first rollers of the adjoining link easily come in contact, and the chain is less able to make sharp turns than in the devices shown in 5-97302 and Japanese Patent Publication Sho 59-48204.

Therefore, the radius of the curved part of the guide rail has to be set large, which made it difficult to make the device compact.

In the device shown in Japanese Patent 2675520, the first rollers are installed effectively in the center part of the link of the chain with grips. Therefore, the problem of the relation between the first roller and the guide rail which occurred in the device shown in Japanese Patent Laid-Open Hei 5-97302, does not occur.

However, although the first rollers are installed effectively in the center part of the link in the device shown in Japanese Patent 2675520, the second roller is installed at the position of the connecting part of the link, that is, at the end of the link. Therefore, when the chain with grips travels around a bend in a direction wherein the travel direction is restricted due to the second roller, the center part of each link, which is a rigid body, passes closer to the center of the curved part of the guide rail in a radial direction than the connecting part which is the end of the link, as shown in FIGS. 13A and 13B. That is, the relation between distances a1, a2 between the edge of the guide-rail and the first roller in the straight part (FIG. 13B), and distances b3, c3 between the edge of the guide rail and the first roller in the curved part (FIG. 13A), is c3<a1=a2<b3.

Therefore, when the chain with grips travels around a bend in a direction wherein the travel direction is restricted by the second roller, the first rollers slip sideways in the radial direction of the curved part of the guide rail in the contact part with the guide rail, and wear of the guide rail in this part was comparatively large. Moreover, the first rollers themselves suffer relatively large wear and an unsuitable force acts on the bearings of the first rollers, so durability was poor. Further, as the first rollers slip sideways in the contact part with the guide rail as they travel, noise is generated, and this was a contributing factor to deterioration of the working environment.

Further, it is disclosed in the device shown in Japanese Patent 2675520, that while the chain with grips is traveling, the first rollers which pass through an action part on a first roller guide surface lower than other parts, displace following the contour of this action part and the grip mechanism opens. However, each link of the chain with grips is supported by the guide surface of the guide rail via the first rollers. Therefore, regardless of the disclosure of this Koho, when the first roller follows the action part, the link itself will probably also displace according to the displacement of the first rollers, and it is not certain whether or not the grip mechanism will open.

In the device shown in U.S. Pat. No. 4,638,906, the first rollers are installed in an approximately center part of the link of the chain with grips. Therefore, the problem of the relation between the first rollers and the guide rail which occurred in the device shown in Japanese Patent Laid-Open Hei 5-97302 does not occur.

Further, in the device shown in U.S. Pat. No. 4,638,906, the second roller is installed in an approximately center part of the link of the chain with grips, as in the case of the first rollers. Therefore, the device shown in U.S. Pat. No. 4,638,906 does not have the problem of the device shown in Japanese Patent 2527724 and Japanese Patent 2675520 either. That is, when the chain grips travels around a bend in a direction wherein the travel direction is restricted due to the second roller, the first rollers do not slip sideways in the radial direction of the guide rail in the contact part with the guide rail. Therefore, the various problems due to the first rollers slipping on the guide surface of the guide rail do not arise.

However, in the device shown in U.S. Pat. No. 4,638,906, the second roller is attached on one side of the link of the chain with grips, and the second roller and grip mechanism are provided on the same side of the base to facilitate assembly and removal of the chain link. Therefore, a construction is adopted whereby the grip mechanism is installed in layers to avoid interference with the second roller. Therein, two projections provided in the link have the function of supporting the grip mechanism, but this projection must have a smaller thickness than the outer diameter of the second roller, and as a result, durability to shocks in the action of the grip mechanism or the load due to repeated gripping and release of the printed matter was comparatively low.

Moreover, in the device shown in U.S. Pat. No. 4,638,906, the link of the chain with grips had a comparatively complex shape wherein a socket was provided at one end in the longitudinal direction, a plug was provided at the other end, and two projections were provided to attach the grip mechanism in the center part. In addition, the surfaces of the socket and plug had to be precision finished to prevent any obstruction when the plug was inserted in the socket, and the two projections also had to be finished so that the grip mechanism could be installed in a stable condition. Therefore, manufacturing costs were high.

It is therefore an object of this invention, in a printed matter transport device wherein a printed matter is gripped in a grip mechanism of a chain with grips and transported along a guide rail, to prevent first rollers and a second roller from slipping on a contact part with the guide rail and to improve the durability of the guide rail and chain with grips.

It is a further object of this invention, in a printed matter transport device wherein a printed matter is gripped in a grip mechanism of a chain with grips and transported along a guide rail, to permit relatively easy displacement of a link, and to prevent misalignment or falling out of the printed matter, and damage to the printed matter, even if an external force acts on the printed matter gripped and transported by a grip mechanism.

It is a further object of this invention, in a printed matter transport device wherein a printed matter is gripped in a grip mechanism of a chain with grips and transported along a guide rail, to strengthen a connecting part of a link and the grip mechanism in the chain with grips, simplify the construction thereof, and reduce manufacturing costs.

It is a further object of this invention, in a printed matter transport device wherein a printed matter is gripped in a grip mechanism of a chain with grips and transported along a guide rail, to stabilize the grip mechanism and grip the printed matter firmly, at least when it is picked up, during picking up and release of the printed matter using a chain with grips satisfying the aforesaid objects.

It is a further object of this invention, in a printed matter transport device wherein printed matter is gripped in a grip mechanism of a chain with grips and transported along a guide rail, to grip the printed matter more firmly when a chain with grips satisfying the aforesaid objects is at a position corresponding to a discharge part in a folding device.

To achieve the aforesaid objects, this invention comprises a chain with a grip mechanism, this mechanism comprising: plural bases wherein two legs having a suitable gap are provided at one end of a longitudinal direction, a projection of smaller width than the gap is provided in the gap between the two legs at the other end, throughholes having a common center line and perpendicular to the longitudinal direction are provided in the two legs and a spherical bearing is provided in the projection, the throughholes of the two legs and a throughhole of the spherical bearing of the projection being connected by a connecting member, wherein each base is free to undergo an angular displacement within a suitable angular range in the gap between these legs relative to the two legs of the adjacent base, these bases being disposed in a continuous arrangement, a first roller free to rotate about an axis parallel to the center line of the throughholes of the two legs on both sides of the approximate center in the longitudinal direction of each base, a second roller provided on one side excluding the sides on which the first roller was provided at the approximate center in the longitudinal direction of each base, the second roller being free to rotate in a perpendicular direction to the center line of the first rollers, a curved first grip member having a predetermined width provided on the remaining side excluding the sides on which the first rollers were provided at the approximate center in the longitudinal direction of each base and excluding the side on which the second roller was provided, which is formed in one piece with the base, extends slightly inclined relative to the longitudinal direction of the base, and is parallel to the center line of the throughholes of the two legs, a curved second grip member free to rotate around a center line parallel to the center line of the throughholes of the two legs, supported on the side of the base on which the first grip member is attached and corresponding to the first grip member, having at least approximately the same width as the first grip member, and exerting a grip action in conjunction with the first grip member, an arm whereof one end is connected to the second grip member, and the other, free end is situated further from the base than the first roller in a direction parallel to the center line of the throughholes of the two legs, which is free to undergo an angular displacement together with the second grip member, this arm comprising a cam follower free to rotate on the free end via a shaft provided perpendicular to the opposite face to the end faces of the first rollers, pressure-applying means which applies a pressure so that the second grip member is forcefully pressed against the first grip member, a guide rail installed in a predetermined transport path for printed matter, and comprising guide parts disposed in the longitudinal direction which respectively guide the first roller and second roller, chain drive means disposed to act on a predetermined position of the chain with grips at a position wherein the guide rail is divided which causes the chain with grips to travel along the guide rail, and a cam member installed in a predetermined position in the transport path of printed matter, which causes the second grip member to separate from the first grip member against the force of the pressure-applying means by interfering with the cam follower.

To achieve the aforesaid objects, this invention further comprises an engaging means which engages with the first roller in an interval wherein a printed matter is gripped by the interference of the cam follower with the cam member.

To achieve the aforesaid objects, according to this invention, the engaging means is a sprocket wheel comprising the chain drive means.

To achieve the aforesaid objects, according to this invention, the guide rail is provided between a position corresponding to a printed matter discharge part of a folding device and a position corresponding to a printed matter receiving part of a collecting device, and the cam member is provided at least in a position corresponding to the printed matter discharge part of the folding device and a position corresponding to the printed matter receiving part of the collecting device.

To achieve the aforesaid objects, according to this invention, this invention further comprises a delivery fan comprising a printed matter receptacle for receiving the printed matter discharged by the folding device, and the first grip member and second grip member of the chain with grips passing along the guide rail in a position corresponding to the printed matter discharge part of the folding device, are disposed such that they grip the printed matter in conjunction with the delivery fan.

DESCRIPTION OF THE PREFERRED EMBODIMENT(S)

Figure 1:
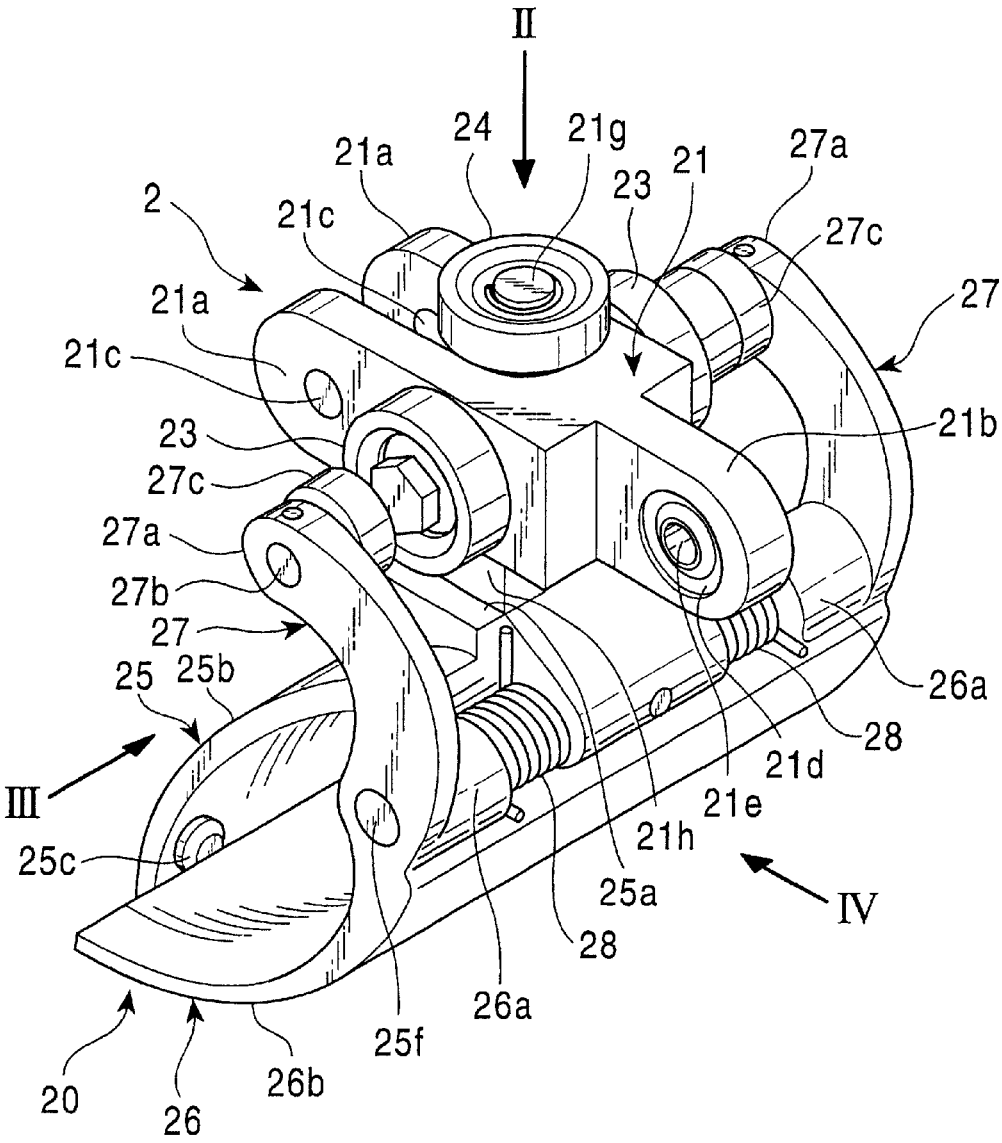
FIG. 1 is a perspective view showing a link forming a chain with grips.

Next, one embodiment of this invention will be described referring to the drawings.

Figure 2:
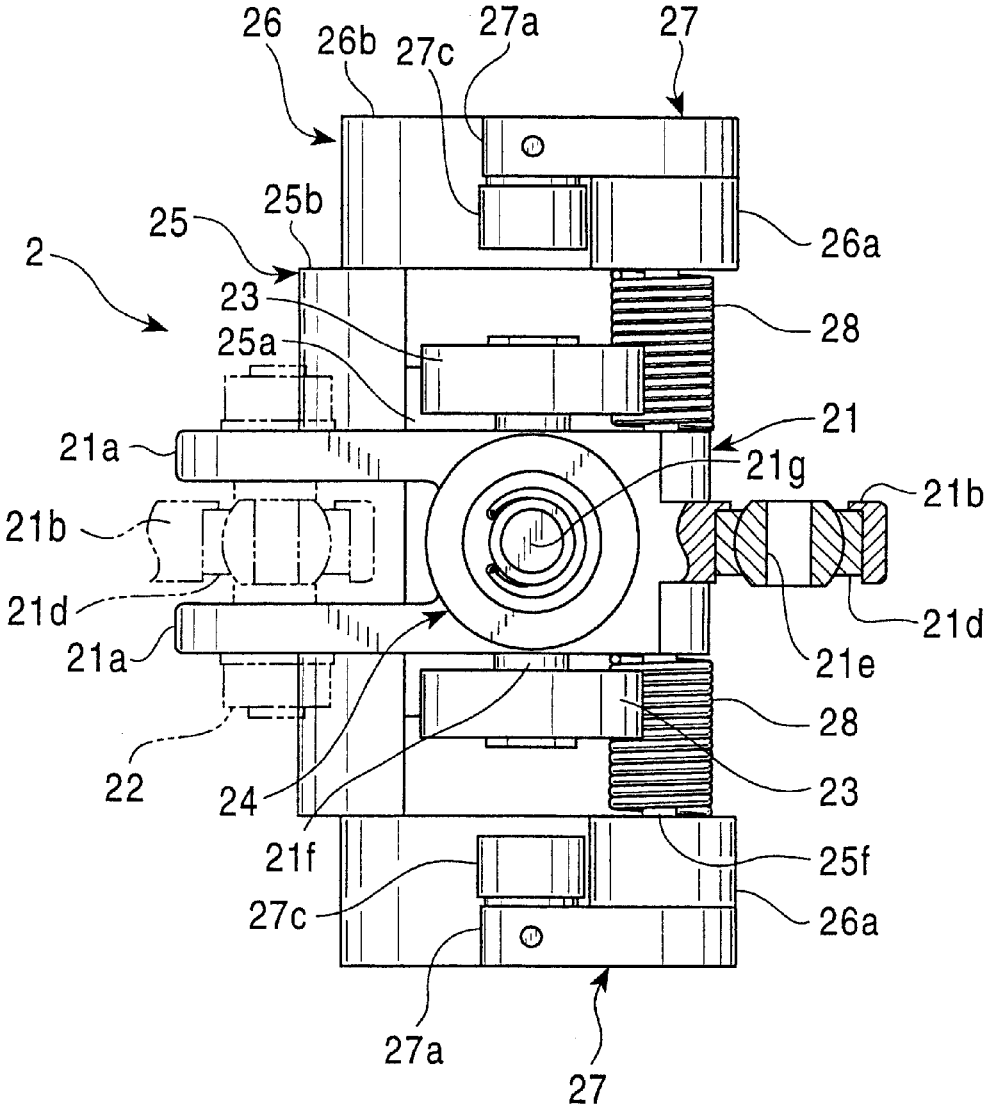
FIG. 2 is a sectional view along an arrow II of the link shown in FIG. 1.
Figure 3:
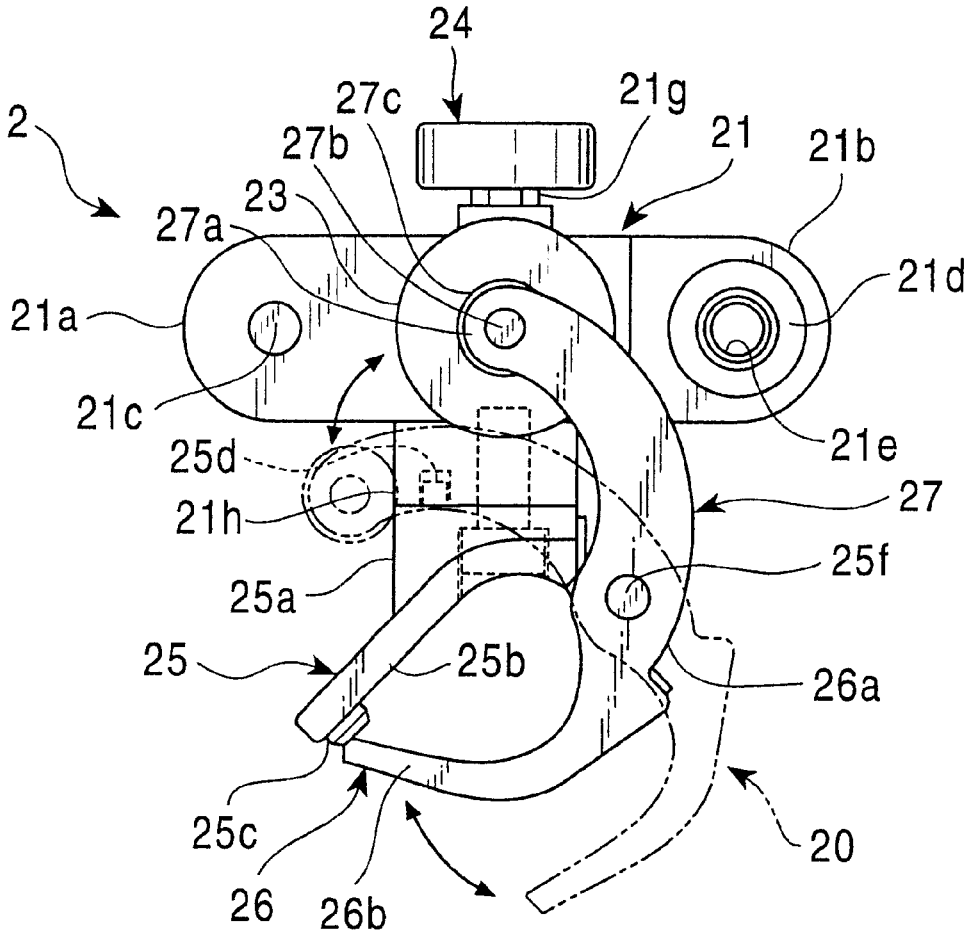
FIG. 3 is a sectional view along an arrow III of the link shown in FIG. 1.
Figure 4:
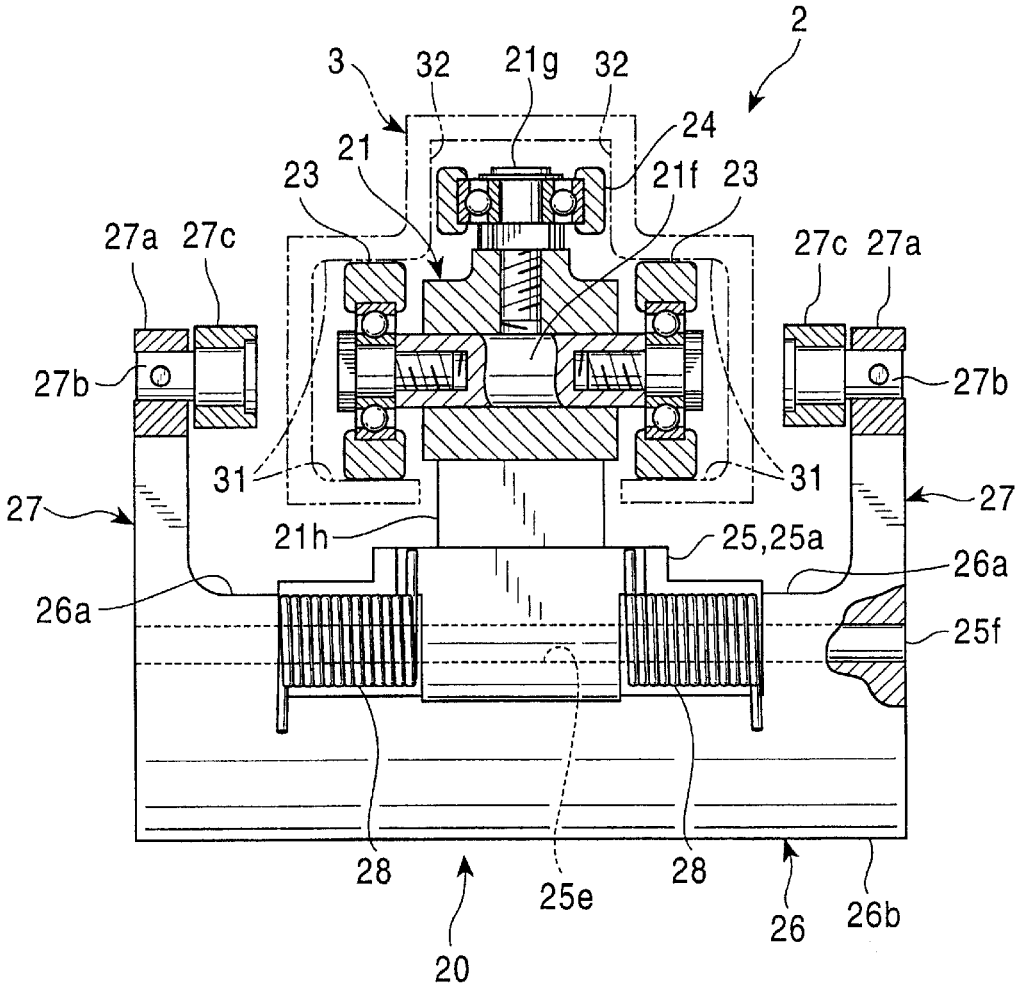
FIG. 4 is a sectional view along an arrow IV of the link shown in FIG. 1.

FIG. 1 is a perspective view of a link in a chain with grips. FIG. 2 is a partial sectional view along an arrow II of the link shown in FIG. 1. FIG. 3 is a view along an arrow III of the link shown in FIG. 1. FIG. 4 is a view along an arrow IV of the link shown in FIG. 1.

A chain 1 with grips (FIG. 6, FIG. 7) is formed by joining plural links 2.

The link 2 has the following construction.

The link 2 has a base 21 of substantially rectangular parallelepiped shape. The base 21 comprises two legs 21*a*, 21*a* provided parallel to the longitudinal direction and at a suitable interval along a side face on one end in the longitudinal direction, and a projection 21*b* provided parallel to the longitudinal direction effectively in the center of the other end in the longitudinal direction. The legs 21*a*, 21*a*, and projection 21*b* of the base are disposed so that when the bases 21 are arranged in series in a longitudinal direction, the projection 21*b* of one base can be inserted comfortably between the legs 21*a*, 21*a*, of another of the bases 21, and is free to undergo an angular displacement within a suitable angular range so that when the chain bends to the front, back, left or right relative to the longitudinal direction, a sufficiently large curvature can be obtained.

Throughholes 21*c*, 21*c* which have a common centerline perpendicular to the longitudinal direction are provided in the legs 21*a*, 21*a*, of the base 21, and a spherical bearing 21*d* is fitted to the projecting end 21*b* of the base 21 so that the throughholes 21*c*, 21*c* can be lined up facing each other when the projecting end 21*b* is inserted between the legs 21*a*, 21*a*. When the bases 21 are arranged in series in a longitudinal direction, the throughholes 21*c*, 21*c* of the legs 21*a*, 21*a*, of one base 21 of adjoining bases 21, 21, and a throughhole 21*e* provided in the center of the spherical bearing 21*d* of the projecting end 21*b* of the other base 21, can be joined by a connecting member 22 (FIG. 2), and in two connected bases 21, 21, one of the bases 21 has a degree of freedom permitted by the spherical bearing 21*d* relative to the other base 21.

The base 21 is provided with a shaft 21*f* (FIG. 4) parallel to the centerline of the throughholes 21*c*, 21*c* in the approximate center of the two sides parallel to the longitudinal direction, and first rollers 23, 23 are attached to its ends free to rotate.

The base 21 is provided with a perpendicular shaft 21*g* relative to the shaft 21*f* approximately in the center of one of the other two sides parallel to the longitudinal direction excepting the sides on which the first rollers 23, 23 are installed, and a second roller 24 is attached to the end free to rotate.

Further, the base is provided with a projection 21*h* which projects slightly from the approximate center of the remaining side parallel to the longitudinal direction, and a grip mechanism 20 comprising a first grip member 25 and a second grip member 26 is attached thereto. The first grip member 25 comprises a block part 25*a* which has an attachment surface to the base 21, and a flat first grip part 25*b* which is formed in one piece with the block part 25*a*, is of larger width than the block 25*a* in a parallel direction to the common center line of the throughholes 21*c*, 21*c*, and curves away on a slant relative to the longitudinal direction of the base 21. A slip stop (for example, a synthetic rubber material) 25*c* which has a sufficient frictional coefficient to hold a printed matter when it is gripped, is attached to the tip side of the first grip part 25*b*. A rotation stop 25*d* (FIG. 3) is further provided on the attachment surface of the block part 25*a* to the base 21, and corresponds with a hole provided in the end face of the projection of the base 21.

On the opposite side of the block part 25*a* from which the first grip part 25*b* extends, a throughhole 25*e* (FIG. 4) 1s provided parallel to the centerline of the throughholes 21*c*, 21*c*, and a supporting shaft 25*f* which supports the second grip member 26 is attached.

The second grip member 26 has a larger width than the first grip member 25, and is attached to the first grip member 25 by the supporting shaft 25*f*. A flat second grip part 26*b* curves away from a supporting part 26*a* toward the tip of the first grip part 25*b* of the first grip member 25. Arms 27, 27 extending in an approximately opposite direction to the second grip part 26*b* are further provided on the supporting part 26*a* of the second grip member 26.

The free ends 27*a*, 27*a* of the arms 27, 27 respectively reach positions opposite the end faces of the first rollers 23, 23 (FIG. 3), and cam followers 27*c*, 27*c* are provided free to rotate via shafts 27*b*, 27*b* provided on their opposite faces and perpendicular thereto.

A force-applying means 28 is attached to the supporting shaft 25*f* between the block part 25*a* of the first grip member 25 and the supporting part 26*a* of the second grip member 26 whereof one end comes in contact with the block part 25*a* of the first grip member 25, and the other end comes in contact with the second grip member 26. This force-applying means 28 presses the tip of the second grip part 26*b* of the second grip member 26 against the tip of the first grip part 25*b* of the first grip member 25. In this embodiment, a torsion spring is used as the force applying means.

Plural links 2 as described above are disposed in series in the longitudinal direction of the base 21, and the through-holes 21*c*, 21*c* of the legs 21*a*, 21*a*, of one base 21 are joined to the throughhole 21*e* provided in the center of the spherical bearing 21*d* of the projecting end 21*b* of another base 21 by the connecting member 22 so as to form an endless chain 1 with grips, as described above.

This chain 1 with grips is installed along a predetermined three-dimensional transport path L between the folding device F of the rotary press and a collecting device S which collects a printed matter P folded and pushed out from this folding device F.

Specifically, a guide rail 3 (FIG. 4, and FIG. 6 to FIG. 9) is provided along most of the transport path L. The guide rail 3 may for example have the cross-sectional shape shown in FIG. 4 by the double dotted line, and is so formed that the part of the chain 1 with grips excepting the grip mechanism 20 can be loaded thereon. The guide rail 3has a first guide surface 31 which guides the first rollers 23 provided to each of the links 2 and a second guide surface 32 which guides the second roller 24 provided to each of the links 2 of the chain 1 with grips when the chain 1 with grips travels along the guide rail 3, the chain 1 with grips being guided in a desired direction by the first guide surface 31 and the second guide surface 32.

A chain drive means 4 (FIG. 5) is further provided to drive the chain 1 with grips along the guide rail 3. The chain drive means 4 engages with the chain 1 with grips and applies a force to drive it along the rail in the forward direction, and is provided in a position where the guide rail 3 is split in the longitudinal direction to avoid interfering with the guide rail 3. In an engaging means 40, a shaft 40*a* is connected with a drive source 40*b*. As the engaging means 40, a sprocket wheel 41 of the type shown in FIG. 6 may for example be used.

The chain 1 with grips which travels along the transport path L must hold the printed matter P, and release the gripped printed matter P at a desired position. Cam members 5 (FIG. 6, FIG. 7, FIG. 9) are provided at predetermined positions along this transport path L, for example C (FIG. 5), which is a position corresponding to the discharge part where the printed matter P folded in the folding device F is discharged, where the printed matter P is gripped, and positions R1, R2 and R3 (FIG. 5), which are positions corresponding to a receiving part for receiving the printed matter P in the collecting device S which accumulates and collects the printed matter P, where this printed matter P is released. The cam members 5 are provided so that the cam followers 27*c*, 27*c* of the arms 27, 27 provided to every grip mechanism 20 of the chain 1 with grips which travels along the transport path L, can interfere with them.

Next, the action of this embodiment will be described referring to FIG. 5 to FIG. 9.

Figure 5:
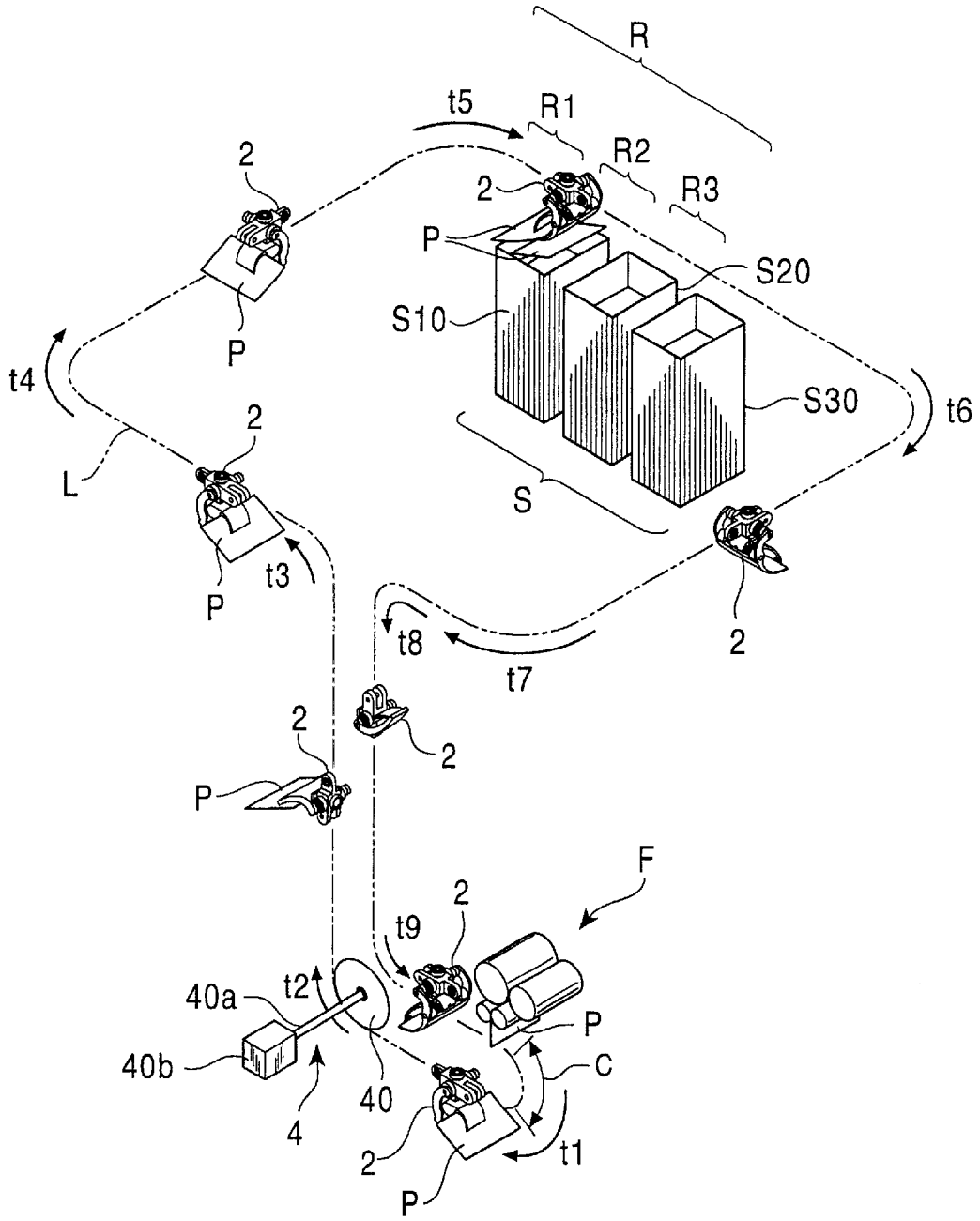
FIG. 5 is a schematic diagram showing an embodiment wherein the transport device of this invention is installed in an endless arrangement between a folding device and a collecting device which collects a printed matter in a rotary press.

The chain 1 with grips is caused to travel in directions shown by arrows t1 to t9 along the guide rail, not shown in FIG. 5, for example along the transport path L shown in FIG. 5. During the course of this travel, when the travel direction changes from vertical to horizontal or in the reverse sense in FIG. 5, i.e., when the travel direction changes in the sequence t1, t2, t3, t8, t9 in FIG. 5, the chain 1 with grips is guided by the first guide surface 31 (FIG. 4) of the guide rail 3, and when the travel direction changes in a horizontal plane in FIG. 5, i.e., when the travel direction changes in the sequence t4, t5, t6, t7 in FIG. 5, the chain 1 with grips is guided by the second guide surface 32 (FIG. 4) of the guide rail 3.

Figure 10A:
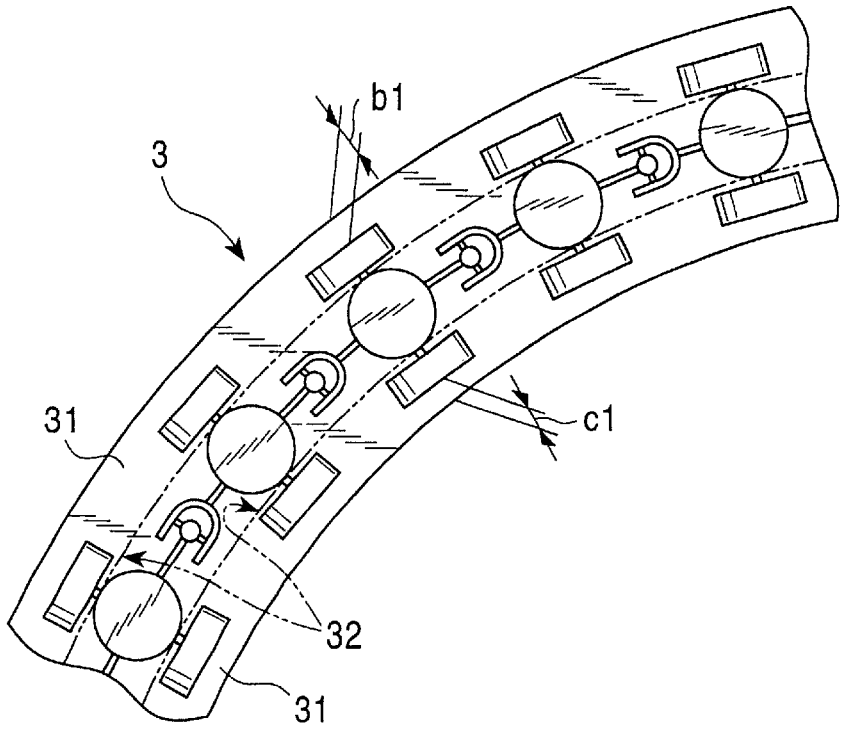
FIGS. 10A and 10B are schematic views showing a state wherein the chain with grips of this invention follows the contour of a guide rail as it travels.
Figure 10B:
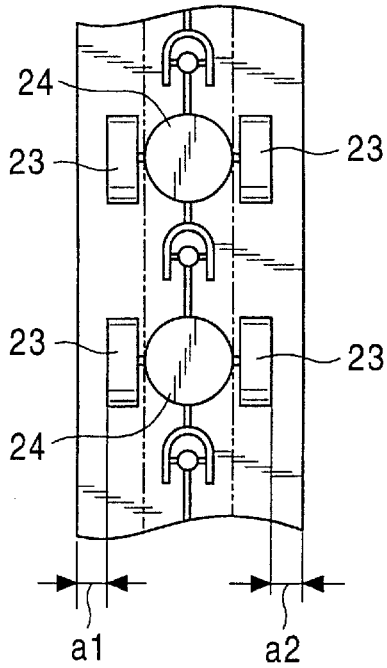
Figure 11A:
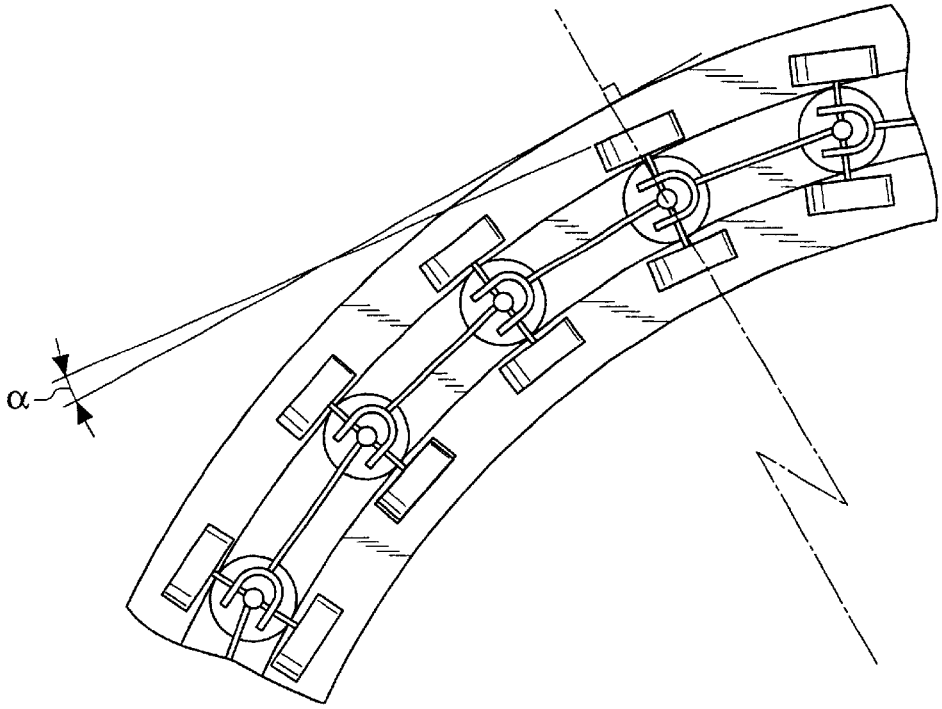
FIG. 11A PRIOR ART
FIGS. 11A and 11B are schematic view showing a state wherein a chain with grips according to one example of the prior art follows the contour of a guide rail as it travels.
Figure 11B:
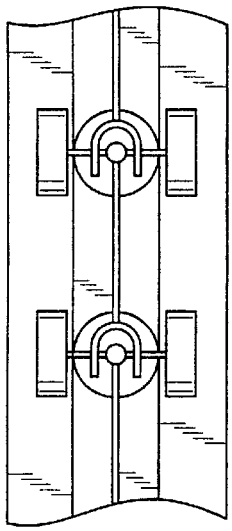
FIG. 11B PRIOR ART
Figure 12A:
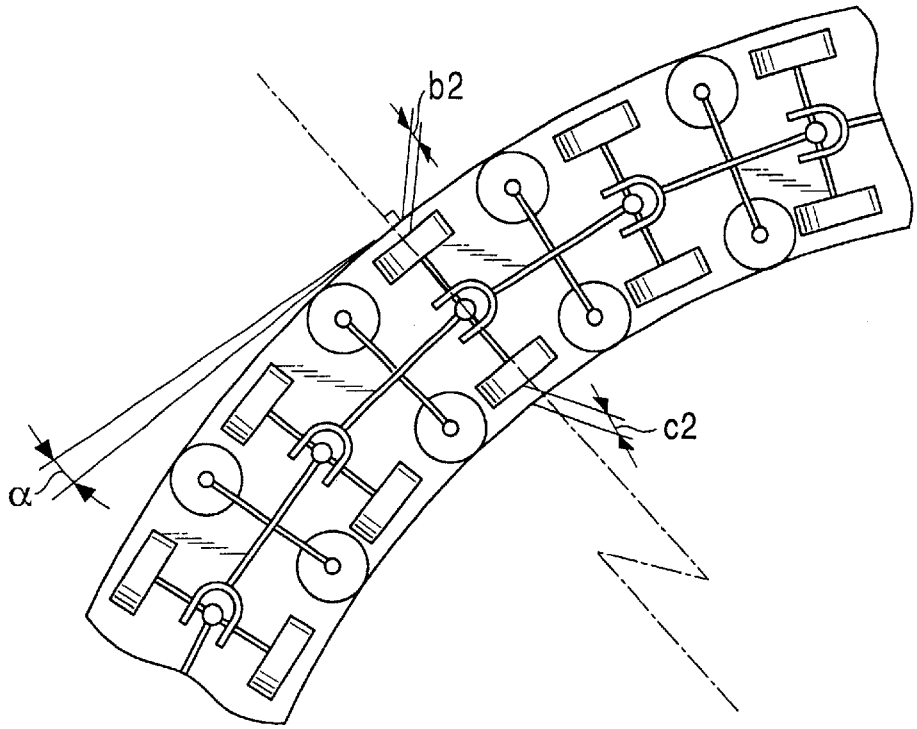
FIG. 12A PRIOR ART
FIGS. 12A and 12B are schematic view showing a state wherein a chain with grips according to one example of the prior art follows the contour of a guide rail as it travels.
Figure 12B:
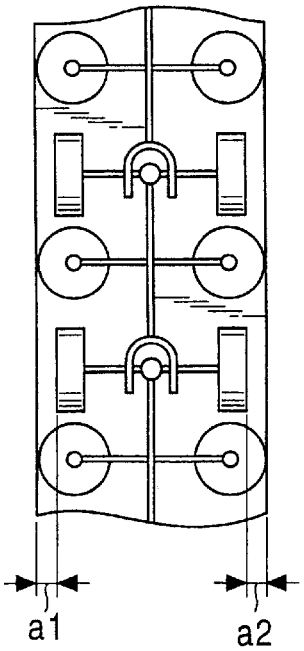
FIG. 12B PRIOR ART
Figure 13A:
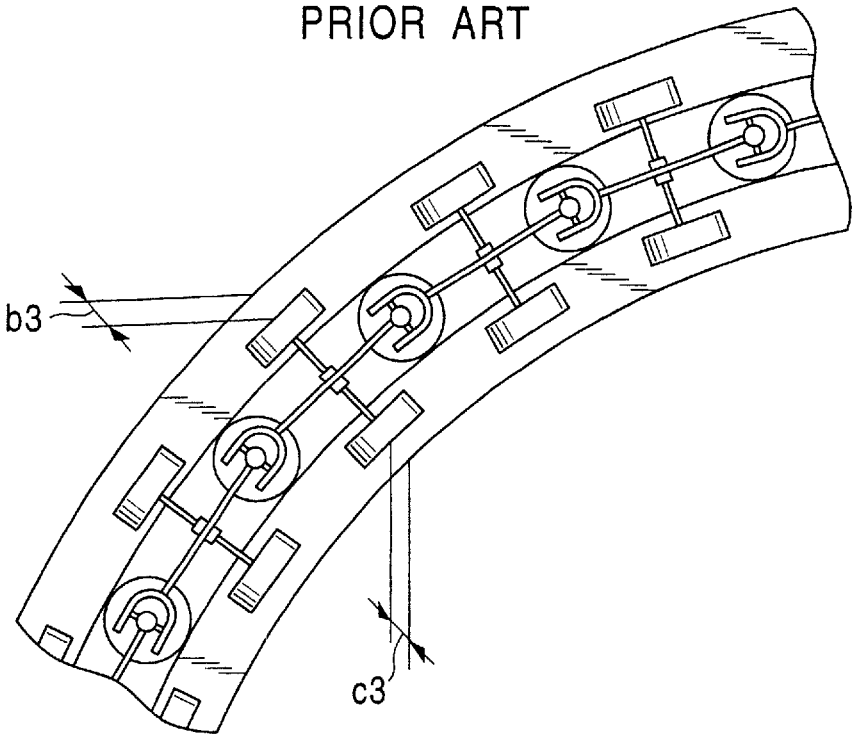
FIG. 13A PRIOR ART
FIGS. 13A and 13B are schematic view showing a state wherein a chain with grips according to one example of the prior art follows the contour of a guide rail as it travels.
Figure 13B:
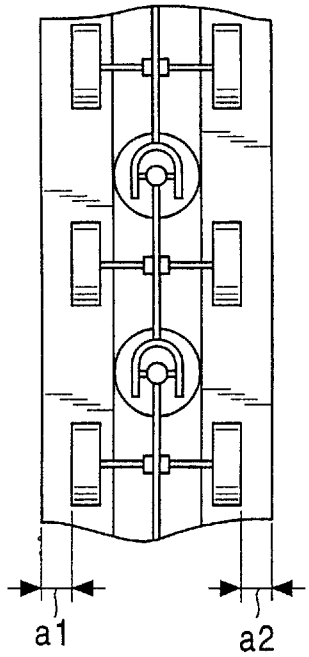
FIG. 13B PRIOR ART

When the chain 1 with grips of the present invention, wherein the first rollers 23 and second roller 24 are provided in the approximate center of the base 21 of the link 2, changes direction as shown by t4, t5, t6, t7, i.e., even when the chain 1 with grips travels in a direction restricted by the second roller 24, the first rollers 23 are parallel to the travel direction of the chain 1 with grips, i.e., parallel to the tangential direction of the curved part of the guide rail 3, as shown in FIGS. 10A and 10B, and the relation of the distances a1, a2 between the rim of the straight part of the guide rail 3 and the end faces of the first rollers, and the distances b1, c1 between the rim of the curved part of the guide rail 3 and the end faces of-the first rollers 23, is a1=a2=b1=c1. Therefore, the first rollers 23 of the chain 1 with grips do not slip on the first guide surface 31 of the guide rail 3.

Further, the chain 1 with grips wherein the first rollers 23 and second roller 24 are provided in the approximate center of the base 21 of the link 2, can displace relatively freely without restriction on the links 2, 2 due to interference of the first rollers 23 and second roller 24 with the guide rail 3 at the two ends in the longitudinal direction of the links 2.

It has already been described that the chain 1 with grips the printed matter P at a predetermined position as it travels along the transport path L, transports the printed matter P, and releases it at a predetermined position.

At the position C where the printed matter P is gripped in the folding device F shown in FIG. 5, the printed matter P may be received and gripped by the grip mechanism 20 of the chain 1 with grips alone, or the printed matter P may be received and gripped in conjunction with a delivery fan D. In FIG. 5, an example of a chain drive means is shown which may be used also in the case where the delivery fan D is used.

One embodiment wherein the printed matter P is received and gripped by the grip mechanism 20 of the chain 1 with grips alone, will now be described referring to FIG. 6.

The chain 1 with grips is guided by a guide rail 3*a* near a discharge part F1 of the folding device F which discharges the printed matter P, and is wound onto the engaging means 40, which in this embodiment is the sprocket wheel 41, at a position corresponding to the discharge part F1 for discharging the printed matter P, where the guide rail 3 is split to change the travel direction so that the contact part of the first grip member 25 and second grip member 26 of the grip mechanism 20 face the discharge part F1. After traveling through approximately one semicircle of the sprocket wheel 41, it is then guided downstream along a guide rail 3*b*. Two of the sprocket wheels 41, which face each other across a slightly larger gap than the width of the base 21 of the link 2 of the chain 1 with grips, are attached so that they rotate together on a shaft 41*a* to engage the first rollers 23 provided to the link 2 of the chain 1 with grips, and have depressions 41*b* on their outer circumference which engage with the first rollers 23 of the chain 1 with grips. Due to these depressions 41*b,* the two sprocket wheels 41 keep the grip mechanism 20 stable when receiving and holding the printed matter P by constraining the first rollers 23 on either side of the chain 1 with grips.

Figure 6:
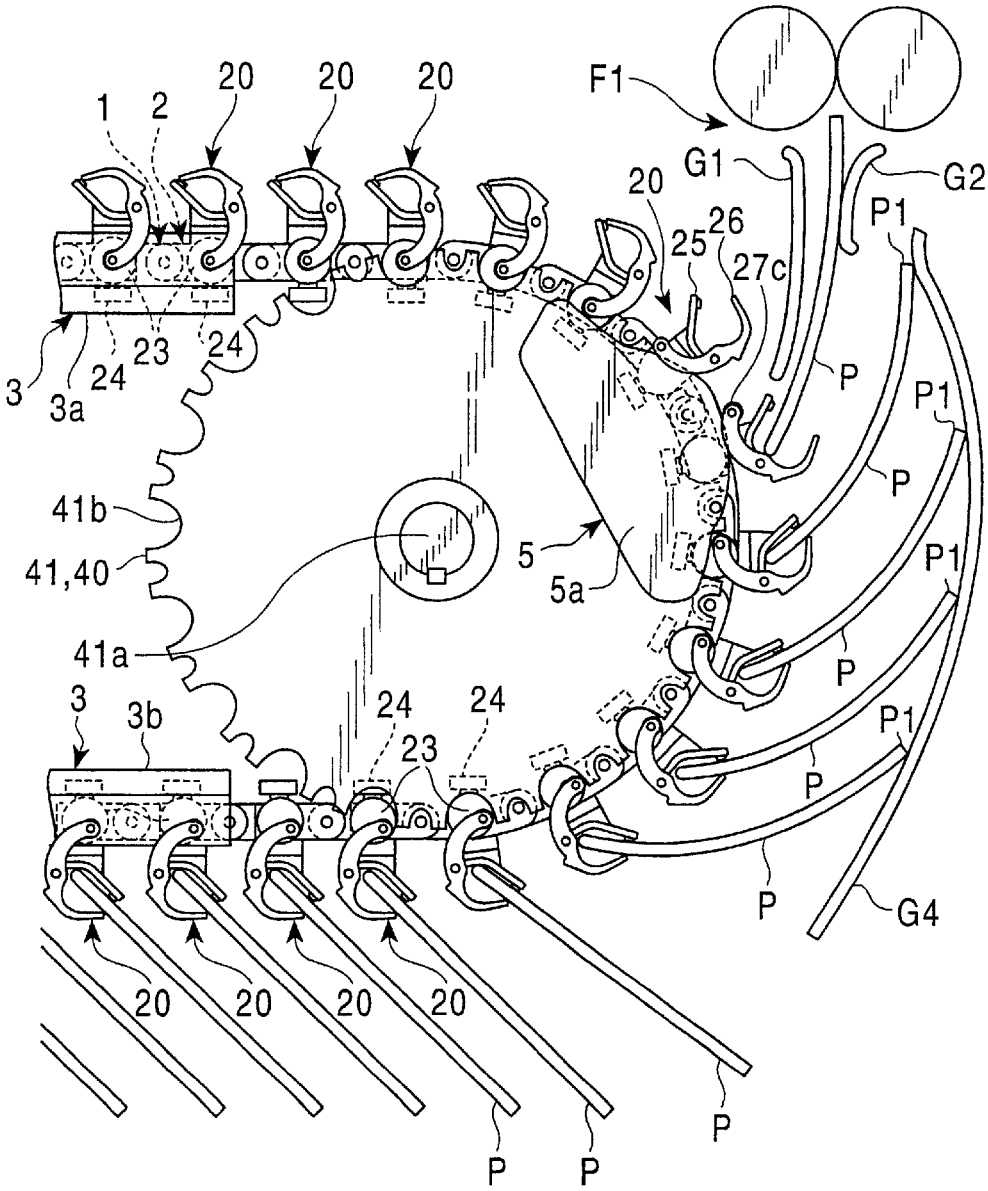
FIG. 6 is a side elevation showing an embodiment wherein this invention is provided to grip the printed matter discharged by the folding device.

Moreover, in the embodiment shown in FIG. 6, a cam member 5*a* with which the cam follower 27*c* of the grip mechanism 20 of the chain. 1 with grips interferes, is provided on the outside of the two sprocket wheels 41. The shape and attachment position of the cam member 5*a* is determined so that the grip mechanism 20 of the chain 1 with grips, which displaces due to the rotation of the sprocket wheel 41, can open in the upper half of the sprocket wheel 41 to receive the printed matter P and close to grip the printed matter P at a position where the chain enters the lower half. The cam member 5*a* is provided facing the front and reverse of the plane of the paper in FIG. 6, for example, by a suitable means such that it is firmly attached and does not interfere with other parts. It is supported by a bracket, not shown, in a frame, not shown, which supports the shaft 41*a.*

In this embodiment, the printed matter P discharged from the discharge part F1 is guided by guide means G1, G2 for guiding the printed matter P, and is received by the open grip mechanism 20 of the chain 1 with grips. The grip mechanism 20 which received the printed matter P closes and grips the printed matter P before an upstream end P1 of the printed matter P leaves the support of the guide means G1, G2. The chain 1 with grips grasping the printed matter P then transports the printed matter P to a position R (FIG. 5) where the printed matter P is released, described later.

In FIG. 6, G4 is a guide member which guides the upstream end P1 of the printed matter P so that the printed matter P transported by the chain 1 with grips does not hang down under its own weight.

Next, an embodiment will be described of a construction wherein the delivery fan D and the grip mechanism 20 of the chain 1 with grips receive and grip the printed matter P together, referring to FIG. 7 and FIG. 8.

In this embodiment, plural (four in FIG. 8) delivery fans D are provided to rotate together on a shaft D1 such that the inlets of plural pockets formed by a thin plate material attached in an approximately tangential direction at equidistant positions on the outer circumference, sequentially face a position corresponding to the discharge part F1 of the folding device F for discharging the printed matter P. A guide rail 3*c* which guides the chain 1 with grips between these plural delivery fans D is provided so that it returns after performing half a revolution around the shaft D1. The travel speed of the chain 1 with grips guided by the guide rail 3*c* is set to be slightly less than the rotation circumferential speed of the bottom of the pocket of the delivery fan D. Further, the grip mechanism 20 of the chain 1 with grips is arranged so that it intersects with an imaginary circumferential surface formed by extending the path of the bottom of the pocket of the delivery fan D perpendicular to the plane of the paper in FIG. 7, in the return half of the half-revolution around the shaft D1.

Figure 7:
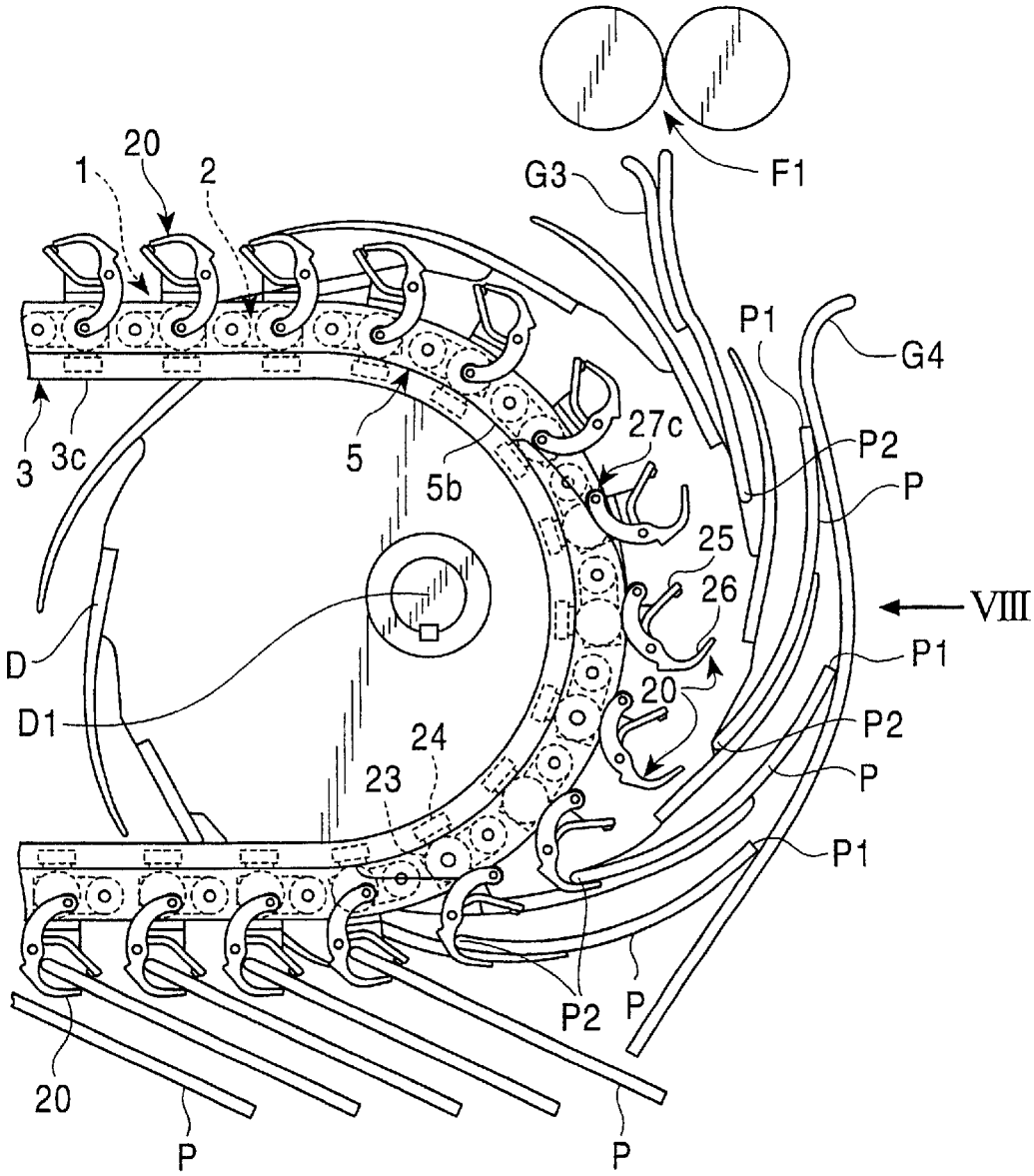
FIG. 7 is an embodiment wherein this invention is provided to grip the printed matter discharged by the folding device, and is a side elevation showing a different embodiment to that shown in FIG. 6.
Figure 8:
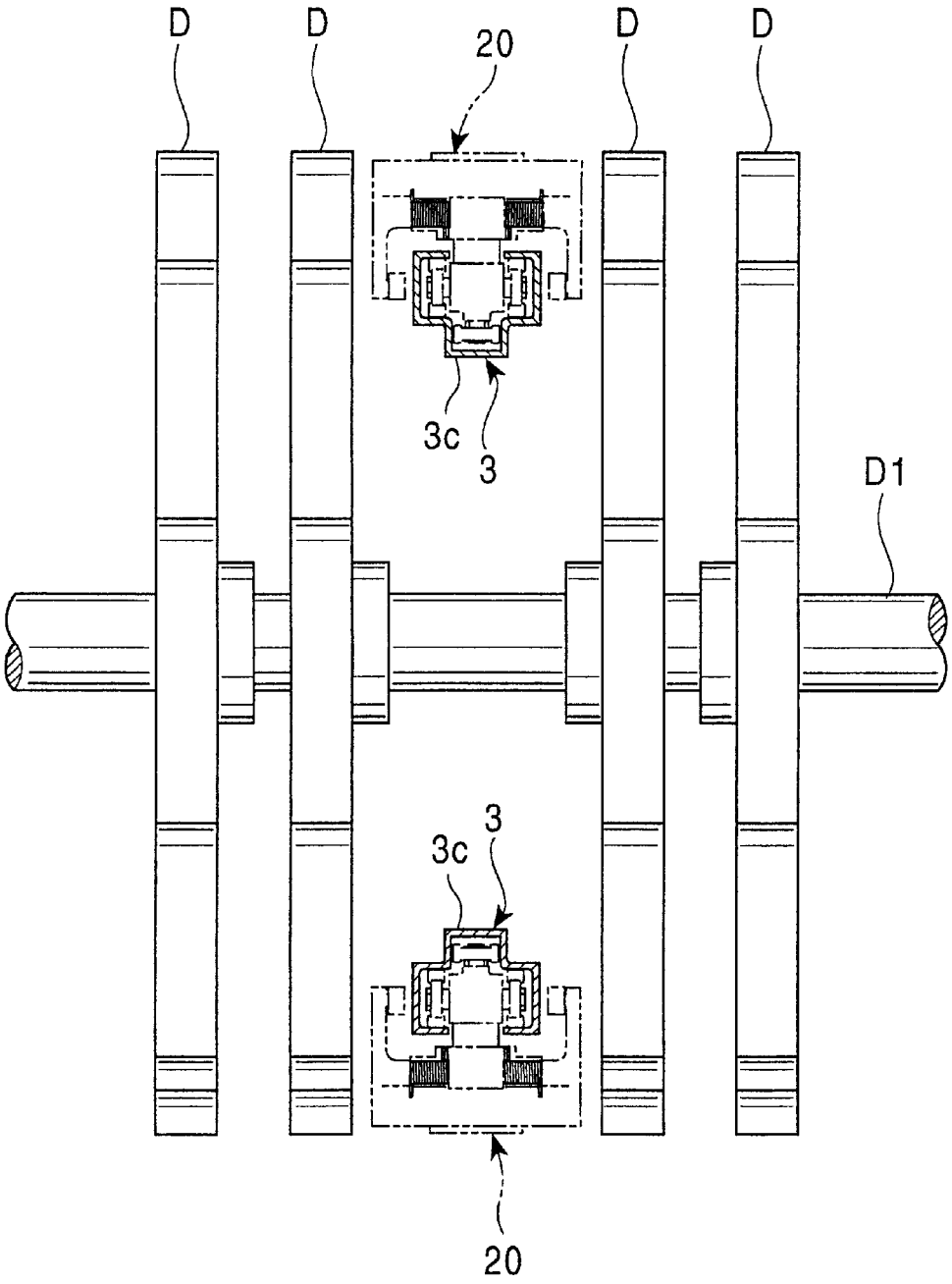
FIG. 8 is a view along an arrow VIII of the embodiment shown in FIG. 7.

As shown in FIG. 7, in this embodiment, the cam member 5*b* with which the cam follower 27*c* of the grip mechanism 20 of the chain 1 with grips interferes, is attached on the two outer sides facing the delivery fan D of the part of the guide rail 3*c* which performs half a revolution around the shaft D1. The shape and attachment position of the cam member 5*b* is determined so that the grip mechanism 20 of the chain 1 with grips which moves along the guide rail 3*c,* opens to its maximum extent at a position where it enters the lower half of its half-revolution around the shaft D1, closes at a position where the half-revolution is completed as it re-enters the straight portion, and can grip the printed matter P as the printed matter P is pushed out from the pocket of the delivery fan D.

In this embodiment, the printed matter P discharged from the discharge part F1 is guided by a guide means G3 for guiding the printed matter P, and received by the pocket of the delivery fan D. The delivery fan D which received the printed matter P continues rotating, and arrives at the opening of the grip mechanism 20 of the chain 1 with grips whereof the bottom of the pocket has opened to the maximum extent. A downstream end P2 of the printed matter P in the pocket then enters the opening of the grip mechanism 20 of the chain 1 with grips 1, which is traveling at a slower speed than the rotation circumferential speed of the base of the pocket of the delivery fan D, and comes in contact with the second grip member 26 of the grip mechanism 20. The delivery fan D continues rotating, and therefore the printed matter P in the pocket of the delivery fan D is gradually pushed out from the pocket by the second grip member 26. The grip mechanism 20 closes slightly earlier to grip the printed matter P than it is pushed out completely from the pocket of the delivery fan D. The chain 1 with grips grasping the printed matter P transports it to the position R, described later, where the printed matter P is released.

In FIG. 7, G4 is a guide member which guides the upstream end P1 of the printed matter P so that the printed matter P transported by the chain 1 with grips does not fall down under its own weight.

Next, the action of releasing the printed matter P transported by the chain 1 with grips 1 will be described referring to FIG. 9. The chain 1 with grips is made to travel along the transport path L in the state where the grip mechanism 20 holds the printed matter P by the guide rail 3, and arrives at the position R where the printed matter P is discharged, for example the positions R1, R2, R3 corresponding to a printed matter receiving part S1 (FIG. 9) of the collecting device S which accumulates and collects the printed matter P shown in FIG. 5.

Figure 9:
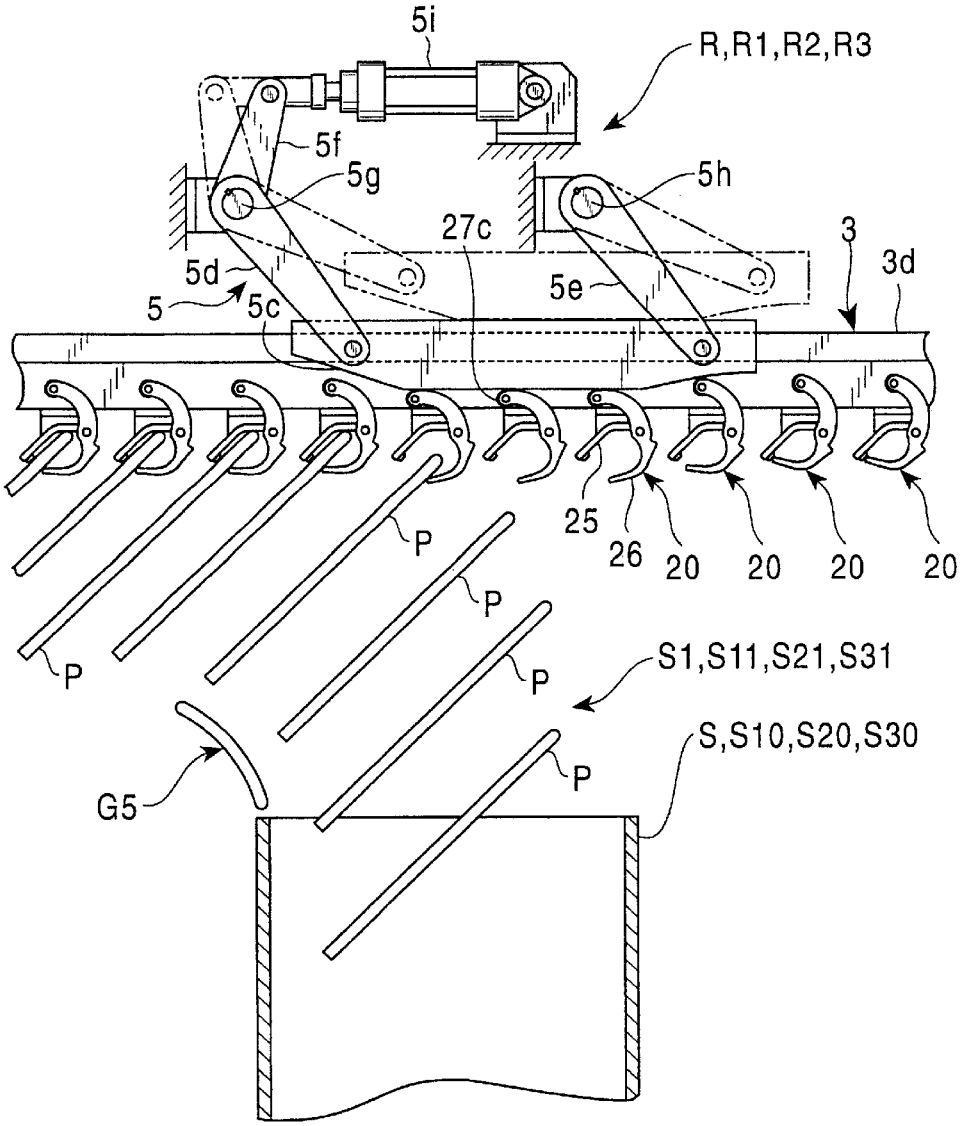
FIG. 9 is a side elevation showing an embodiment wherein this invention is provided to release the printed matter.

A cam member 5*c,* for example of the type shown in FIG. 9, is disposed on either side of the width direction of a guide rail 3*d* provided at the positions R1, R2, R3 corresponding to the printed matter receiving part S1, and is free to displace between a position where the cam follower 27*c* of the grip mechanism 20 of the chain 1 with grips traveling along this guide rail 3*d* can interfere (position shown by the solid line in FIG. 9), and a position where the cam follower 27*c* of the grip mechanism 20 cannot interfere (position shown by the double dotted line in FIG. 9). Specifically, a link mechanism is formed from links 5*d,* 5*e* whereof two of each are disposed in the width direction of the guide rail 3*d,* the links 5*d,* 5*d* on either side of the width direction of the guide rail 3*d* being supported so that they can undergo an angular displacement together via a shaft 5*g,* the links 5*e* , 5*e* being supported so that they can undergo an angular displacement together via a shaft 5*h,* and the free ends of these links 5*d,* 5*d,* 5*e* , 5*e* being connected to the cam members 5*c,* 5*c* respectively disposed on either side of the width direction of the guide rail 3*d* so that they can undergo an angular displacement. Further, the free end of a link 5*f* free to rotate together with the shaft 5*g* is connected to an output rod of a hydraulic cylinder 5*i* whereof the tail end is supported free to undergo an angular displacement.

In this embodiment, a collecting device S10 (S20, S30) which collects the printed matter P is selected by a command from a control unit not shown, of the collecting device S. The output rod of the hydraulic cylinder 5*i* at the position R1 (R2, R3) corresponding to a printed matter receiving part S11 (S21, S31) of the collecting device S10 (S20, S30) then withdraws, and the cam member 5*c* is displaced to the position shown by the solid line in FIG. 9.

The cam follower 27*c* of the grip mechanism 20 of the chain 1 with grips interferes with the cam member 5*c* so that the grip mechanism 20 opens, and the printed matter P held therein is released. The printed matter P so released falls from the receiving part S11 (S21, S31) into the collecting device S10 (S20, S30). The collecting device S10 (S20, S30) may be appropriately changed over when collection of a predetermined number of printed matters is complete or for other reasons.

When changing over the collecting device S10 (S20, S30) sequentially from the upstream side, the cam member 5*c* at the position R1 (R2, R3) corresponding to the printed matter receiving part S11 (S21, S31) is first set in the position shown by the solid line in FIG. 9. When changing over to the downstream collecting devices S20 and S30, the upstream cam member 5*c* may be changed over by moving it to the position shown by the double dotted line shown in FIG. 9.

In FIG. 9, G5 is a guide member which guides the released printed matter P into the printed matter receiving part S11 (S21, S31) without fail.

This invention is not limited to the embodiment described above, and instead of the chain drive means 4 for driving the chain 1 with grips 1 shown in FIG. 5, the sprocket wheel 41 shown in FIG. 6 may be connected to a drive source, not shown.

As described above, according to the present invention, a chain with grips is caused to grip a printed matter by a grip device. Therefore, wear of a guide rail and guide rollers in a chain with grips in a printed matter transport device wherein the chain is made to travel along the guide rail is reduced, and as a result, the durability of the guide rail and guide rollers (first guide roller in the embodiment) in the chain with grips is improved.

In the chain with grips of this invention, the guide rollers are provided only in the center parts of the links of the chain, so even when the links are connected to form a chain, the links do not suffer a constraint due to the joint action of guide rollers at both ends of the longitudinal direction and the guide rail. Hence, even if an external force acts on this printed matter while the printed matter is being transported, the links can displace comparatively freely, and the force can be dissipated. Therefore, even if the printed matter is gripped by a comparatively weak force, the printed matter does not become misaligned or fall out when an external force acts upon it, and even if the printed matter is gripped by a comparatively weak force, the printed matter is not damaged when an external force acts upon it.

Moreover, in the present invention, since the attachment side of the grip mechanism and the attachment sides of the guide rollers (second roller in the embodiment) are separate in the link base, the connecting part of the grip mechanism can be made robust and of a desired size, the shape thereof can be made very simple, durability can be improved, and manufacturing costs can be largely reduced.

In the invention of Claims 3 to 6 of this application, the links of the chain with grips, which can displace relatively freely while traveling along the guide rail, are restrained so as not to displace when the printed matter is gripped. Hence, the printed matter can be gripped firmly while the orientation of the grip mechanism remains stable.

Also, in the invention of Claims 9 and 10 of this application, the printed matter can be gripped more firmly without losing freedom of displacement of the links of the chain with grips, which can displace relatively freely while traveling along the guide rail.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A printed matter transport device for transporting printed matter folded by a folding device of a rotary press, to a collecting device, said transport device comprising:

a chain with a grip mechanism comprising:

plural bases wherein two legs having a gap are provided at one end of a longitudinal direction, a projection having a smaller width than the gap provided between the two legs at the other end, throughholes having a common center line and perpendicular to the longitudinal direction provided in the two legs and a spherical bearing provided in said projection, the throughholes of said two legs and a throughhole of the spherical bearing of said projection connected by a connecting member, wherein each base is free to angularly displace within an angular range in the gap between said legs relative to said two legs of the adjacent base, said bases being continuously arranged;

a first roller configured to freely rotate about an axis parallel to the center line of the throughholes of the two legs on both sides of the approximate center in the longitudinal direction of each base;

a second roller provided on one side excluding the sides on which said first roller was provided at the approximate center in the longitudinal direction of each base, said second roller configured to freely to rotate in a perpendicular direction to the center line of said first roller;

a curved first grip member having a predetermined width provided on the remaining side excluding the sides on which said first roller was provided at the approximate center in the longitudinal direction of each base, and the side on which said second roller is provided, formed in one piece with said base, extending slightly inclined relative to the longitudinal direction of said base, and parallel to the center line of the throughholes of said two legs;

a curved second grip member free to rotate around a center line parallel to the center line of the throughholes of said two legs, supported on the side of said base on which said first grip member is attached and corresponding to said first grip member, having at least approximately the same width as said first grip member, and exerting a grip action in conjunction with said first grip member;

an arm having one end and another free end, one said end connected to said second grip member, and said free end is situated further from said base than said first roller in a direction parallel to the center line of the throughholes of said two legs, and is free to undergo an angular displacement together with said second grip member, said arm comprising a cam follower free to rotate on said free end via a shaft provided perpendicular to the opposite face to the end face of said first roller; and pressure-applier that applies a pressure so that said second grip member is forcefully pressed against said first grip member;

a guide rail installed in a predetermined transport path for printed matter, and comprising guide parts disposed in the longitudinal direction which respectively guide said first roller and second roller;

a chain drive disposed to act on a predetermined position of said chain with said grip mechanism at a position wherein said guide rail is divided which causes said chain with said grip mechanism to travel along said guide rail; and a cam member disposed in a predetermined position in the transport path of a printed matter, which causes said second grip member to separate from said first grip member against the force of said pressure-applier by interfering with said cam follower.

2. The printed matter transport device as defined in claim 1, further comprising an engagement mechanism configured to engage said first roller in an interval wherein the printed matter is gripped by the interference of said cam follower with said cam member.

3. The printed matter transport device as defined in claim 2, wherein said engagement mechanism comprises a sprocket wheel comprising said chain drive.

4. The printed matter transport device as defined in claim 1, wherein:

said guide rail is provided between a position corresponding to a printed matter discharge part of said folding device and a position corresponding to a printed matter receiving part of said collecting device; and said cam member is provided at least in a position corresponding to the printed matter discharge part of said folding device and a position corresponding to the printed matter receiving part of said collecting device.

5. The printed matter transport device as defined in claim 4, further comprising a delivery fan comprising a printed matter receptacle for receiving the printed matter discharged by said folding device, wherein said first grip member and second grip member of said chain with grip mechanism passing along said guide rail in a position corresponding to the printed matter discharge part of said folding device, are disposed such that they grip the printed matter in conjunction with said delivery fan.

6. A printed matter transport device for transporting printed matter folded by a folding device of a rotary press, to a collecting device, said transport device comprising:

a chain with a grip mechanism comprising:

plural bases wherein two legs having a gap are provided at one end of a longitudinal direction, a projection having a smaller width than the gap between said two legs is provided at the other end, throughholes having a common center line and perpendicular to the longitudinal direction provided in said two legs and a spherical bearing provided in said projection, the throughholes of said two legs and a throughhole of the spherical bearing of said projection connected by a connecting member, wherein each base is free angularly displace within an angular range in the gap between said legs relative to said two legs of the adjacent base, said bases being continuously arranged;

a first roller configured to freely rotate about an axis parallel to the center line of the throughholes of said two legs at the approximate center in the longitudinal direction of each said base;

a second roller provided at the approximate center in the longitudinal direction of each said base, said second roller being free to rotate in a perpendicular direction to the center line of said first roller;

a first grip member fixed to said base at the approximate center in the longitudinal direction of each said base on side opposite to that on which said second roller is provided;

a second grip member supported by said first grip member and configured to freely rotate around a center line parallel to the center line of the throughholes of said two legs, and configured to exert a grip action in conjunction with said first grip member;

an arm comprising a cam follower connected to said second grip member, and which is free to rotate around a center line parallel to an angular displacement center line of said second grip member; and pressure-applier that presses said second grip member against said first grip member so as to grip a printed matter;

a guide rail disposed in the transport path for printed matter, and comprising guide portions disposed in the longitudinal direction of said chain with said grip mechanism which respectively guide said first roller and said second roller;

a chain driver disposed in the path of the printed matter, which drives said chain with grip mechanism along said guide rail; and a cam member disposed in the transport path of the printed matter, which causes said second grip member to separate from said first grip member against the force of said pressure-applier by interfering with said cam follower.

7. The printed matter transport device as defined in claim 6, further comprising an engagement mechanism configured to engage said first roller in an interval wherein the printed matter is gripped by the interference of said cam follower with said cam member.

8. The printed matter transport device as defined in claim 7, wherein said engagement mechanism comprises a sprocket wheel comprising said chain drive.

9. The printed matter transport device as defined in claim 6, wherein:

said guide rail is disposed between a position corresponding to a printed matter discharge part of said folding device and a position corresponding to a printed matter receiving part of said collecting device; and said cam member is disposed at least in a position corresponding to the printed matter discharge part of said folding device and a position corresponding to the printed matter receiving part of said collecting device.

10. The printed matter transport device as defined in claim 9 further comprising a delivery fan comprising a printed matter receptacle for receiving the printed matter discharged by said folding device, wherein said first grip member and second grip member of said chain with said grip mechanism passing along said guide rail in a position corresponding to the printed matter discharge part of said folding device, are disposed such that they grip the printed matter in conjunction with said delivery fan.

* * * * *

UNITED STATES PATENT AND TRADEMARK OFFICE

CERTIFICATE OF CORRECTION

PATENT NO. : 6,386,816 B1
DATED : May 14, 2002
INVENTOR(S) : Y. Uera et al.

It is certified that error appears in the above-identified patent and that said Letters Patent is hereby corrected as shown below:

Title page,
Item [75], Inventors, "Yoshinori Urea" should be -- Yoshinori Uera --.
Item [56], References Cited, FOREIGN PATENT DOCUMENTS, include:

| | | |
|---|---|---|
| -- JP | 5-97302 | 4/1993 |
| JP | 59-48204 | 11/1984 |
| JP | 2527724 | 6/1996 |
| JP | 2675520 | 7/1997 |
| JP | 8188313 | 7/1996 |
| JP | 2534175 | 6/1996 |
| JP | 2727281 | 12/1997 |
| WO | 92/02442 | 2/1992 -- |

Signed and Sealed this

Twelfth Day of August, 2003

JAMES E. ROGAN
*Director of the United States Patent and Trademark Office*